United States Patent [19]

Snipes

[11] Patent Number: 4,907,955

[45] Date of Patent: Mar. 13, 1990

[54] DRYWALL FINISHING TOOL

[76] Inventor: Jerry T. Snipes, 312 Canary, St. Charles, Mo. 63301

[21] Appl. No.: 276,939

[22] Filed: Nov. 28, 1988

[51] Int. Cl.[4] ..... B05B 11/02; E04F 21/06

[52] U.S. Cl. ..... 425/87; 15/105.5; 15/235.3; 222/528; 401/48; 401/138; 401/193; 401/263; 425/90; 425/458

[58] Field of Search ..... 425/87, 90, 458; 15/235.4, 235.3, 105.5, 235.7, 235.8, 104 S, 245; 401/137, 138, 171, 193, 263, 139.5, 48; 222/502, 526, 528, 536

[56] References Cited

U.S. PATENT DOCUMENTS

| | | | |
|---|---|---|---|
| 866,984 | 9/1907 | Thomson | 15/235.8 |
| 1,541,964 | 6/1925 | John et al. | 15/105.5 |
| 1,828,738 | 10/1931 | Hood | 425/87 |
| 2,094,703 | 8/1937 | Hitzman | 15/235.4 |
| 2,398,985 | 4/1946 | Welch | 401/263 |
| 2,618,149 | 11/1952 | Lynn | 401/263 |
| 2,683,981 | 7/1954 | Richey | 401/193 |
| 2,824,326 | 2/1958 | Ames | 401/171 |
| 2,824,442 | 2/1958 | Ames | 425/87 |
| 3,888,611 | 6/1975 | Ames | 425/87 |
| 4,132,517 | 1/1979 | Ames | 425/87 |
| 4,135,651 | 1/1979 | Hession et al. | 425/458 |
| 4,230,441 | 10/1980 | Heronema | 425/87 |
| 4,571,170 | 2/1986 | Tackett et al. | 425/458 |

*Primary Examiner*—Jeffery Thurlow
*Assistant Examiner*—Mathieu Vargot
*Attorney, Agent, or Firm*—Haverstock, Garrett & Roberts

[57] ABSTRACT

A drywall finishing tool for applying plaster to a wall surface including a guide assembly useful for guiding the tool when applying a plaster substance to a surface adjacent to an outside corner having a corner edge defined by angularly related wall surface, or alternatively for applying plaster to a surface between spaced wall corner edges such as the outside corner edges around an opening between adjacent rooms, the guide assembly having a portion blocking an end of an outlet opening in the tool and including a guide portion extending outwardly therefrom for making sliding contact with the outside corner edge of the wall surface to control and guide movement of the tool when applying plaster to the wall surface adjacent thereto. The tool may include spaced guide assemblies for engaging spaced outside wall corner edges and alternatively the tool may include a corner guide member pivotally attached to the side walls of the tool and adjustable to extend outwardly therefrom to a position where it can engage an outside corner edge.

18 Claims, 3 Drawing Sheets

DRYWALL FINISHING TOOL

The present invention relates to a device generally utilized in drywall finishing, and more specifically, to a device for applying plaster or a like material to surfaces which form and are adjacent to outside corner edges such as for applying plaster to one or both surfaces forming outside corner edges around an opening or a passageway between adjacent rooms. The present device can also be used to apply a layer of plaster to a surface adjacent to or between outside edges formed by cornerbeads. An important feature of the present device is that it has means adaptable to be mounted on a plaster application tool for guiding the tool along one or along two outside corner edges simultaneously to control application of plaster to surfaces adjacent thereto.

There are in existence devices for dispensing plaster and other cementitious materials to surfaces forming walls, and the historical way of doing so is to use a plaster blade or knife. In recent years there have been developed other tools useful for applying plaster to plane surfaces. These include devices having chambers for containing a supply of plaster and means for forcing the plaster cut through an opening as the tool is moved over the surface. Typical of such devices are the devices shown in Ames U.S. Pat. Nos. 3,888,611 and 4,132,517.

The present invention represents an improvement over these known devices and enables a user to utilize the same proven principles, but instead of being limited to using the device for applying plaster to plane surfaces such as midsections of a wall, the present device also enables accurate application of plaster to surfaces adjacent to and forming one or two outside corner edges. The ability to quickly, accurately and smoothly apply plaster to these surfaces provides a substantial saving in time, minimizes waste due to spillage and improves the appearance and smoothness of finished surfaces. The present tool also includes controllable means for adjusting the application width of plaster, and further provides means used when applying a strip of plaster to a surface between spaced outside edges for resiliently engaging both edges as the tool is moved therealong so that, among other things, there will be little or no waste. Still further, the means for guiding the present tool along the wall edge or bead can be simply and easily reversed on the tool to enable the same surface to be plastered by moving the tool down as well as up along the same edge. Thus the present invention solves a problem that heretofore was not solved and by modifying and improving existing tools.

The present invention is, therefore, especially well-suited for applying mastics, such as cementitious plaster, in a controlled manner without creating waste, along surfaces forming outside edges or corners adjacent to and between spaced apart outside edges. The present device achieves these results by means of a novel adjustable guide member or members that removably attach to the tool on which they are used and serve to engage an outside corner edge or bead to guide the tool during operation. The present invention may also include spaced guide members at least one of which may be spring loaded to enable a user to guide the tool between two spaced outside edges while dispensing plaster along the surface therebetween. No known device provides these novel features.

The present construction includes a housing or tool body with a chamber adapted for receiving, storing and dispensing mastic material therefrom during a plastering operation. The housing includes spaced apart opposed sidewalls, a movable rear wall with handle means attached thereto, a front wall with a slit type opening, sometimes referred to herein as a mastic outlet opening, through which the plaster being dispensed moves, a top wall and wall engaging guide means attached to the housing adjacent to one or both ends of the outlet opening. The rear pressing wall or plate is pivotally connected to the opposed sidewalls near one end thereof. The tool preferably also has a scraper or trowel member positioned along one side, generally the upper side when moving the tool downwardly, of the outlet opening, and a roller member that serves as a tool positioning member positioned adjacent the opposite edge of the front wall from the outlet opening.

The rear wall or pressure plate should preferably pivot about an axis near the bottom edge of this tool and should make sealing and sliding contact with adjacent surfaces of the housing so that little or no plaster will leak from around the pressure plate as the pressure plate is moved and applies pressure on the plaster to push it out through the outlet opening. The handle connects to and extends from the rear plate, and during operation the handle is positioned so that an operator can grasp the handle and press the tool body against a work surface while at the same time applying force thereon to move the pressing plate about its pivot, that is, around an axis defined by where the opposed sidewalls and plate are hingedly connected. Mastic positioned in the housing will be dispensed from the tool body through the outlet slip opening by applying pressure to continuously force plaster from the chamber. It should also be understood that to make a smooth, even plastered surface, the scraper and roller member should make contact with the wall and wall edge.

The mastic outlet opening generally has a rectangular cross-sectional shape and extends transversely across the front wall near the edge thereof. Generally, the length of the opening is substantially greater than its height, however, the dimensions of the opening can be varied and can have a variety of geometrical shapes. The novel adjustable corner engaging guide means are attachable to the housing adjacent to one or both opposite ends of the opening and the guide means establish the width of the opening. The guide members, which will be described in more detail hereinafter, therefore define the effective open length of the opening and serve as guide members for engaging the wall edge or corner and guiding the tool along the surfaces adjacent to and forming the corner edge or edges or surfaces to be followed during plastering. These features not only reduce the time required to apply plaster along these surfaces, but also substantially reduce waste, improve the surface characteristics of the surfaces being plastered and save the plasterer substantial time and effort in plastering surfaces that heretofore have been difficult to plaster accurately and quickly.

The novel adjustable guide means may be detached from the tool body when desired, such as when the tool is to be used for plastering on a flat surface such as at mid-locations on a wall, and may be quickly and easily attached to the tool body when needed for guiding the tool along an outside corner edge and to adjust the width of the mastic outlet opening. Means are provided to adjust and maintain the guide members on the tool body in position to prevent leakage of mastic.

It is an object of the present invention to provide means to improve the application of plaster to surfaces adjacent to or between spaced outside edges of corner-beads.

Another object is to provide novel means for guiding a plaster application tool along an outside corner formed by angularly related wall surfaces.

Another object is to substantially increase the versatility and usefulness of known plasterer's tools.

Another object is to provide simple and inexpensive means for attaching to plastering tools to aid in applying plaster to surfaces along and adjacent to outside corner edges.

Another object is to provide means to control the width of application of plaster from a plaster storage device.

Another object is to provide means to guide the movement of a plastering tool along a corner, which guide means can be used to plaster the same wall surface by moving the tool downwardly as well as upwardly along the corner.

Another object is to facilitate the plastering of wall surfaces adjacent and between outside corners and to do so faster, easier and more accurately.

Another object is to reduce the time required to plaster wall surfaces formed between spaced wall corners such as are formed between adjacent rooms.

These and other objects and advantages of the present invention will become apparent to those skilled in the art after considering the following detailed specification in accompaniment with the drawings.

DETAIL DESCRIPTION OF THE DRAWINGS

Figure 1:
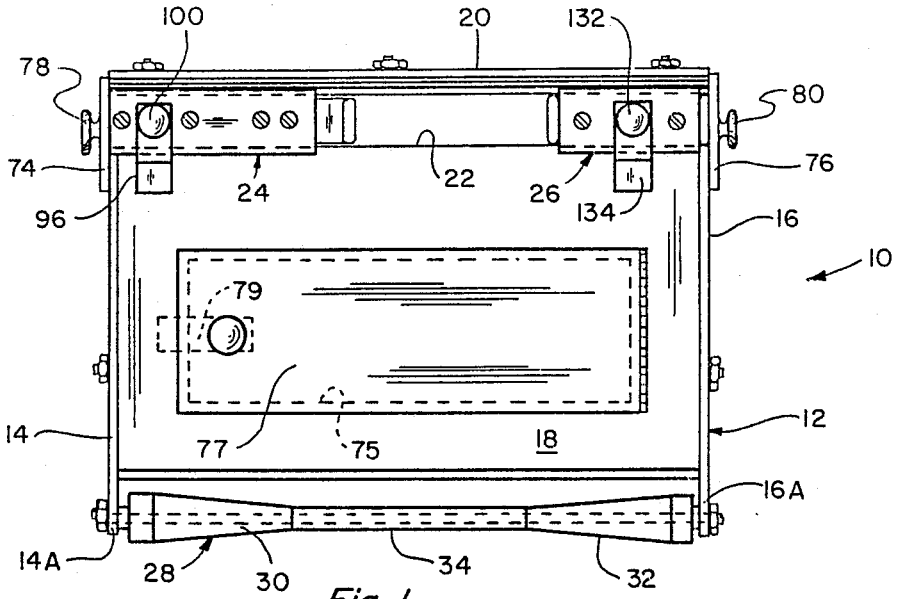
FIG. 1 is an elevational view as seen from the side where plaster is dispensed from a tool equipped with guide means constructed according to one embodiment of the present invention.

Referring to the drawings more particularly by reference numbers, number 10 in FIG. 1 refers to a plaster application tool embodying the teachings of the present invention. The tool includes a housing 12 constructed to receive, store and dispense a mastic material such as plaster therefrom. The housing 12 as seen in FIG. 1 has spaced apart opposed endwalls 14 and 16, a front wall 18 on the side thereof from which plaster is dispensed during operation, and a top wall 20. An elongated slit or opening 22 extends across the wall 18 near one side edge thereof (the upper edge as shown in FIG. 1), and the wall 18 is equipped to receive one and in some cases two guide assemblies 24 and 26 such as the guide assemblies shown in FIGS. 4—6. The guide assemblies 24 and 26 are constructed to be mounted on the wall 18 in position to extend over and to block a portion of one or both opposite ends of the elongated slit or opening 22. As will be explained hereinafter, only one of the assemblies such as assembly 24 is required when laying plaster on a wall surface adjacent to an outside corner such as an outside corner formed by two adjacent right angle walls. Often times, such corners are provided with a corner bead which is a perforated metal member or rail which is used as a guide for plaster laid adjacent thereto. Both of the assemblies 24 and 26 will be mounted on the housing 12 as shown in FIG. 1 when the plaster application tool 10 is used for laying a layer of plaster extending between two spaced corner beads such as the two spaced corner beads on opposite edges of a wall formed between two adjacent room areas.

Figure 2:
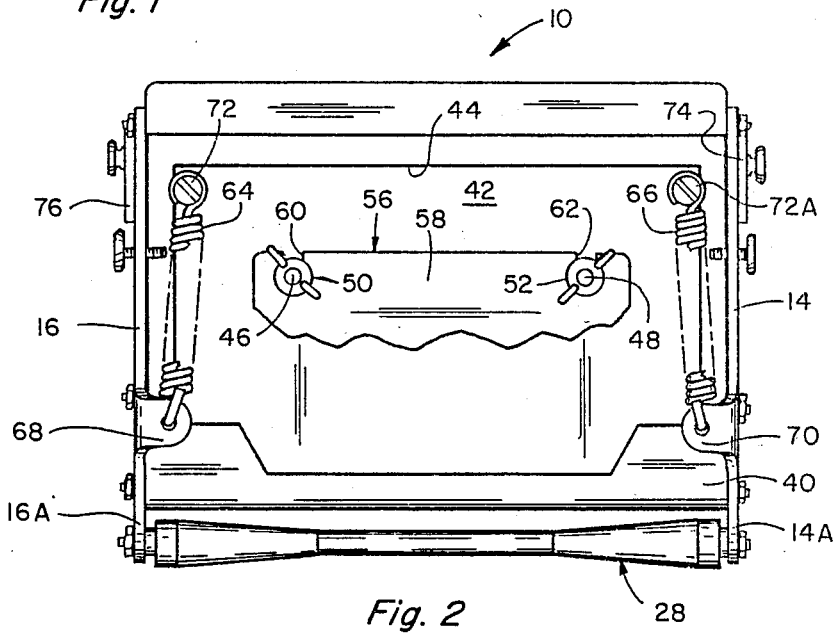
FIG. 2 is an elevational view showing the opposite side of the same tool.

In the construction as shown in FIG. 1, the plaster application tool 10 also has a roller 28 mounted on extensions 14A and 16A of the end walls 14 and 16 and the roller as shown in FIGS. 1 and 2 has spaced frusto-conical end portions 30 and 32 connected by a narrower portion 24 extending therebetween. The purpose of the frusto-conical portions 30 and 32 is to provide means for engaging a corner bead or the like of a corner edge of a wall adjacent to where plaster is being laid by the subject tool.

The tool 10 may be similar in construction to the tools shown in Ames U.S. Pat. Nos. 3,888,611 and 4,132,517, and the subject invention represents an important improvement over the known tools by providing means for guiding the tool along an outside corner edge in order to lay plaster adjacent thereto in a smooth and efficient manner.

Figure 3:
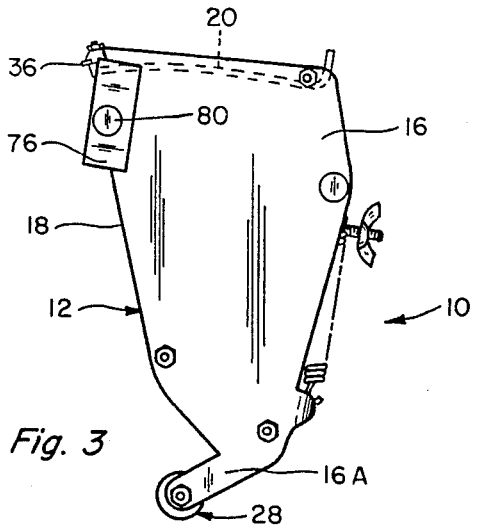
FIG. 3 is a right side view of the tool shown in FIG. 1.

FIG. 3 is a left end view of the tool shown in FIG. 1 showing a scraper blade or edge 36 projecting from the wall 18 of the tool adjacent to and above the opening or slit 22. The purpose of the scraper 36 is to smooth out the plaster that is being dispensed from the tool 10 as the tool is moved down (or up) along a wall being guided in its movements by the assembly 24 and/or 26 as will be described.

Figure 11:
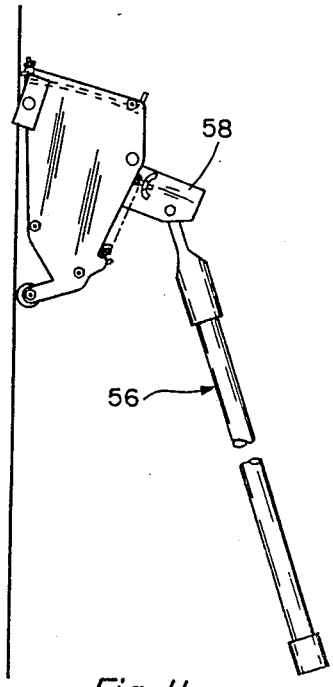
FIG. 11 is a side elevational view showing the subject tool being used to lay plaster on a wall surface.

Referring to FIG. 2, the rear wall 40 of the device 10 is shown having a moveable wall portion 42 hingedly attached near the bottom of the device and extending upwardly to enclose a large opening 44 in the rear wall 40. The wall 42 has a pair of threaded members 46 and 48 attached thereto and each of the threaded members 46 and 48 has a respective wing nut 50 and 52 attached thereto. The wing nuts are loosened or removed to attach a handle assembly 56 (FIG. 11) which includes a flange portion 58 which has notches 60 and 62 which cooperate with the shaft 46 and 48 when attaching the handle assembly 56 thereto. The pivoted wall 42 is sealably engaged around its edges with the inside walls of the container and makes sliding engagement therewith, and the wall 42 is normally biased into an outward position adjacent to the rear wall 40 by means of springs 64 and 66 which are attached between housing lugs 68 and 70 and threaded members 72 and 72A, attached to the wall 42.

When the subject tool is to be used it is filled with plaster or like material through an opening in one of the walls such as opening 75 in the wall 18 which opening is closed and latched by hinged panel 77 and latch 79. The tool may also be filled with a hand operated pump if desired. The panel 77 should be sealed to the wall 18 when closed to prevent plaster from escaping around the panel 77. Also, when filling the housing 12 with plaster the wall 42 is in its rearward or retracted position. When the tool is operated, the handle assembly 56 is raised (see FIG. 11) to press on the plaster contained within the housing 12 so that some of the plaster will be forced out through the opening 22.

As seen in FIG. 3, one or both opposite ends walls 14 and 16 of the housing 12 are provided with pivotal guide members 74 and 76 respectively which are maintained in a desired position during operation by respective threaded members 78 and 80. These members can be used to engage an edge corner in some cases especially where a wider application of plaster is desired. However, when the assemblies 24 and 26 are used the members 74 and 76 may be moved to their inactive positions aligned with the edges of the respective walls 14 and 16. This is also true when using the tool to lay plaster to a flat wall surface away from a corner.

Figure 12:
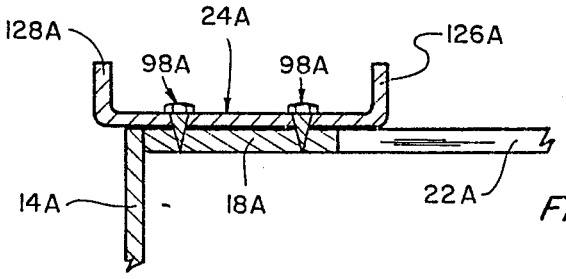
FIG. 12 is a cross-sectional view showing a modified form of guide means mounted on a plasterer's tool of known construction.
Figure 4:
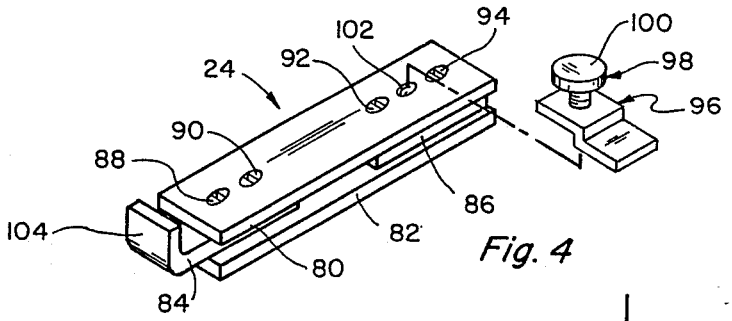
FIG. 4 is an enlarged perspective view of one form of guide assembly for installing on the subject plaster application tool.
Figure 5:
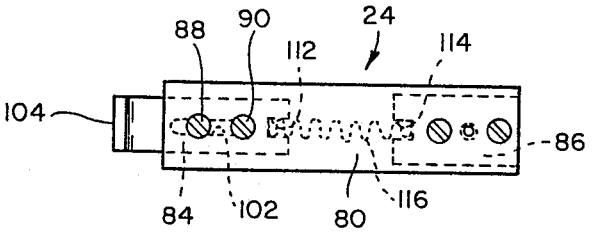
FIG. 5 is a top view of the guide assembly shown in FIG. 4.
Figure 6:
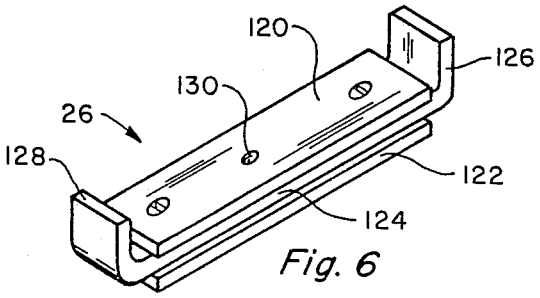
FIG. 6 is a perspective view showing another embodiment of the guide assembly for use on a plasterer's tool.

Of special importance to the present construction are the assemblies 24 and 26, the details of which are shown in FIGS. 4, 5 and 6. In FIG. 4 the assembly 24 is shown as including spaced plate members 80 and 82 which are maintained in spaced relationship by narrower members 84 and 86 positioned therebetween as shown. These members are held together in assembled condition by threaded fasteners 88, 90, 92 and 94. The idea is to construct the members which form the assembly 24 so that the members 84 and 86 will just fit into the space between opposite side edges of the opening 22 adjacent to one end thereof, and in the preferred embodiment of the present construction, the opening 22 extends all the way across the device including through the end walls so that the assemblies 24 and 26 can be installed by sliding them into position from respective ends of the opening with the walls 80 and 82 engaging opposite sides of the wall portion 18 along opposite side edges of the opening 22. When installing the assembly 24 on the housing, it is slid into the opening 22 from one end (either end) and when properly located, a flanged member 96 is positioned extending over a portion of the assembly 24 as shown in FIG. 1 and a threaded member 98 with a knob 100 is threaded into a bore 102 formed in the assembly 24 at the location shown. Pressure is brought to bear on the threaded member 98 to lock the assembly in a desired fixed position. Alternatively the member 80 could be widened and threadedly attached to the wall 18, or the opening 22 could be shortened and an L-shaped member could be attached to the wall 18 beyond the end of the opening 22. In such case means should be provided to assure that plaster can not get into the threads. This can be achieved by thickening the wall when the threaded fasteners are attached or using tapered or self tapping screws. FIG. 12 shows such a simplified construction mounted on a tool adjacent one end of the opening 22A. In this construction the parts are identified by numbers that correspond to the parts numbering in FIGS. 1, 2 and 6 but with the added letter A.

The member 84 which is positioned between the walls 80 and 82 is loosely positioned therebetween and has an elongated opening 102 therethrough that straddles the threaded members 88 and 90 so that it can slide longitudinally a certain amount in the assembly 24 while maintained in its longitudinal orientation by the threaded members 88 and 90. The member 84 has an outwardly extending flanged end portion 104 which is designed to engage a corner bead such as corner beads 106, 108 and 110 shown in FIGS. 7 and 10 when the tool is operated.

Figure 7:
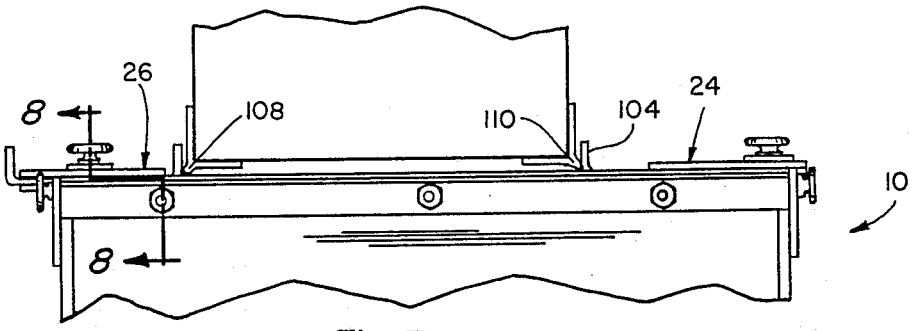
FIG. 7 is a cross-sectional view of a wall having spaced, outside corner edges engaged by spaced guide means on a plaster application tool constructed according to the present invention.

Referring again to FIG. 5, the member 84 has a slot 112 formed in one end thereof, and the member 86 likewise has a similar slot 114 formed in its end. A coil spring 116 is positioned extending between the slots 112 and 114 to urge the member 84 and the flange 104 thereon into an outward or leftward direction as shown in FIG. 5. The purpose of this is to allow the member 104 to follow a corner bead while the other guide assembly 26 is tracking on a corner bead spaced therefrom. This is illustrated in FIG. 7 wherein the spring biased flange 104 makes sliding engagement with the corner bead 110 while a flange on the fixed guide assembly 26 which will be described later is tracking on the corner bead 108 when laying plaster onto the wall space between the corner beads. It is to be recognized, however, that in the construction having spaced assemblies 24 and 26 mounted thereon, when the tool is being moved downwardly on the wall, the flanges will engage respective corner beads as shown but if the tool is to be moved upwardly from near the floor to complete a plastering operation for the same area the reverse situation will take place wherein the flange 104 will engage the bead 108 and a flange on the assembly 26 will engage the flange 110.

Referring to FIG. 6, it can be seen that the assembly 26 is formed by spaced members 120 and 122 with a narrower member 124 extending therebetween. The narrower member 124 has a width approximately equal to the width of the opening 22 and both opposite ends of the member 124 have outwardly extending flanges 126 and 128, either one of which may be positioned to engage a corner bead. The assembly 26 is mounted on the tool 10 in much the same manner as the assembly 24 including having a threaded opening 130 which cooperates with a threaded member 132 (FIG. 1) similar to the member 100 and with a flanged member 134 similar to the flanged member 96 described above to lock it in place. The threaded bore 130 can be located at any desired position along the assembly 26 and its location is usually selected so that when the assembly is installed in one direction, the flange 126 will extend further across the opening 122 than when it is installed in the reverse direction and the flange 128 is used to engage the corner bead.

Figure 9:
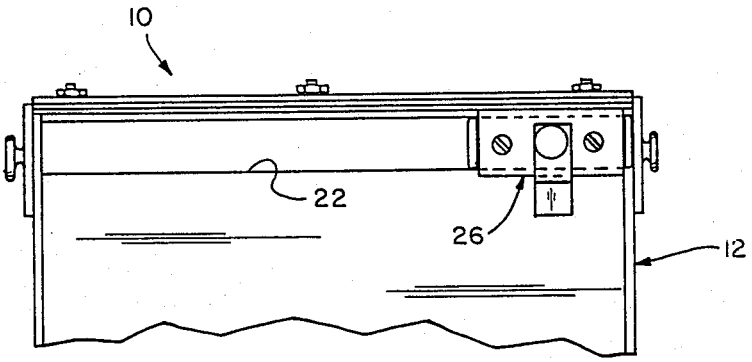
FIG. 9 is a fragmentary side elevational view of a plaster application tool having only one guide assembly installed thereon.
Figure 8:
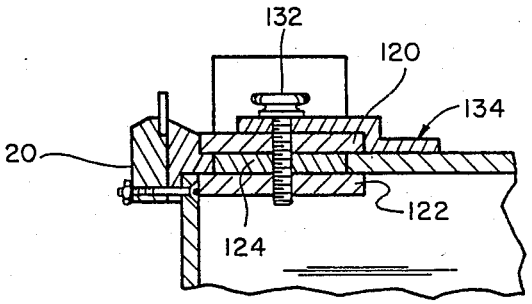
FIG. 8 is an enlarged cross-sectional view taken along the line 8—8 of FIG. 7.

FIG. 9 shows the tool 10 with only the assembly 26 mounted on it and with the opposite end portion of the opening or slit 22 left unobstructed. This is done so that when the tool is used to lay plaster along a corner where the wall extends a considerable distance, a relatively wide strip of plaster can be laid which is desirable. Also, in this condition it is not necessary to as accurately control the width of the plaster that is being laid and it is better to lay as wide a strip as possible. It should also be noted that the assembly 26 will be located on one end of the opening 22 when laying a strip of plaster along one side of a corner bead by coming down from the top or near the ceiling, and if plaster is to also be laid near the bottom of the same strip it will be necessary to relocate the assembly 26 on the opposite side of the opening 22 so that the tool can then be used to lay plaster coming up from near the floor to meet where it was laid from above. Also if the opening 22 is only obstructed by an assembly at one end, the opposite end of the opening can be closed by a closure member (not shown) to prevent leakage of plaster thereby and to control the length of the opening. Alternatively the opening 22 can be made shorter than the width of the tool and the assemblies 24 and 26 can be attached by being bolted or otherwise applied to cover the desired end portion of the opening.

Figure 10:
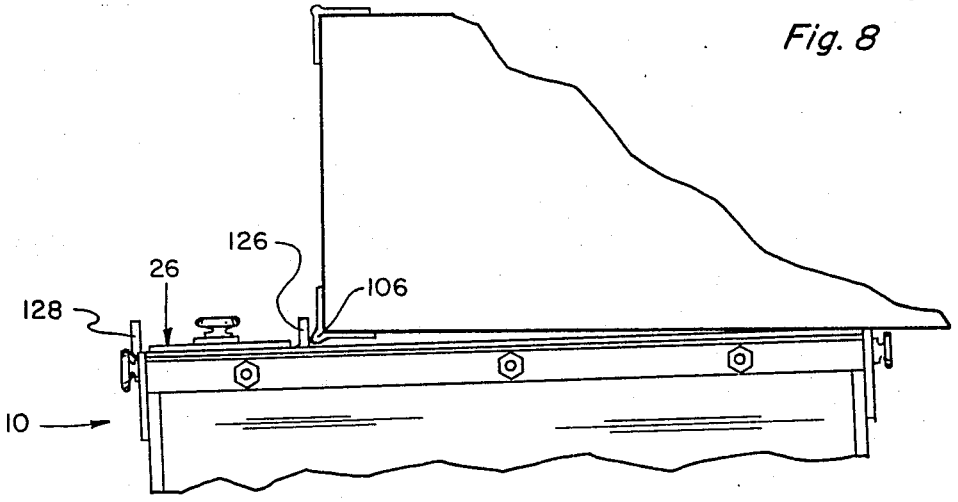
FIG. 10 is a cross-sectional view showing the subject tool being used to lay a smooth surfaced layer of plaster on a wall surface along one side of an outside corner edge.

FIG. 10 shows use of the tool 10 to lay plaster adjacent to the corner bead 106 along one side thereof. In this case the flange 126 on the assembly 26 engages the corner bead 106 and the opposite flange 128 is not used.

Thus there has been shown and described improvements to a plaster application tool for use in laying plaster in a smooth manner from a container along a surface area adjacent to an outwardly extending wall corner where there may be a corner bead or other means located for guide purposes, which improvements fulfill all of the objects and advantages sought therefor. It will be apparent to those skilled in the art, however, that many changes, modifications, variations and other uses and applications for the subject device are possible, and all such changes, modifications, variations and other uses and applications which do not depart from the spirit and scope of the invention are deemed to be covered by the invention which is limited only by the claims which follow.

What is claimed is:

1. A tool for use in applying a smooth layer of plaster to a wall surface extending to and adjacent to an outside corner edge comprising a housing for containing a quantity of plaster, said housing having a front wall for facing a wall surface with an elongated opening extending along and adjacent to an edge thereof, first blocking means mounted on the housing for movement along the outlet opening to block a portion of one end thereof to establish a desired position for the end of the opening, means for locking the first blocking means on the housing in a desired position, said first blocking means having a guide portion extending outwardly from the front wall of the housing in alignment with the desired position of the end of the opening for engaging an outside corner edge of the wall surface to guide the one end of the opening along the outside corner edge along which plaster is to be applied during movement of the tool, the outwardly extending portion of the first blocking means acting as a guide for tool movement and preventing plaster from exiting the opening beyond the corner edge.

2. The tool of claim 1 further comprising second blocking means mounted on the housing at the end of the opening opposite from the first blocking means for blocking the opposite end of the opening, said second blocking means having a portion extending outwardly from the housing for engaging an outside corner edge spaced from the corner edge engaged by the first blocking means for guiding the tool when plastering the wall surface between the corner edges.

3. The tool of claim 2 wherein the outwardly extending portion on the second blocking means is resiliently biased on the housing toward the outwardly extending portion of the first blocking means.

4. The tool of claim 1 including handle means for supporting the housing during operation thereof, said housing including a wall portion attached to the handle means and movable when pressure is applied thereto to force plaster contained therein out through the opening.

5. A plasterer's tool for applying plaster or like substances to a wall surface adjacent to an outside wall corner edge comprising:

a housing for receiving and holding a quantity of plaster, said housing having spaced apart end walls, a top wall, and opposed front and rear walls, said front wall having an elongated outlet opening therethrough adjacent to the top wall, the rear wall including a portion hingedly attached adjacent one edge to the end walls and movable from a position spaced from said front wall to a position adjacent to said rear wall; and guide means mounted on the housing for movement along the elongated opening to block a pre-determined portion of one end thereof, means for attaching the guide means to the housing in a desired position, said guide means having an outwardly extending portion located in alignment with the desired blocked end of the opening for engaging a wall corner edge during movement of the tool therealong to maintain the one end of the opening aligned with the wall corner edge during tool movement preventing plaster from exiting the opening beyond the corner edge.

6. The tool of claim 5 wherein said guide means includes spaced apart guide assemblies mounted on said housing adjacent to opposite ends of the outlet opening.

7. The tool of claim 6 wherein one of said spaced apart guide assemblies includes means biasing the outwardly extending portion thereof toward the outwardly extending portion on the other guide assembly.

8. The tool of claim 5 including means to adjust the position of the guide means relative to the one end of the outlet opening.

9. The tool of claim 5 including scraper means on the housing adjacent one side of the outlet opening.

10. The tool of claim 5 including a roller member extending transversely across the housing on the same side thereof as the outlet opening in position to engage a surface to be plastered at a spaced location from the outlet opening.

11. The tool of claim 10 wherein the roller member is constructed to engage the wall surface at spaced locations therealong.

12. The tool of claim 5 further comprising a handle attached to the rear wall in position to exert force against said rear wall and against the plaster contained in the housing during a plastering operation.

13. The tool of claim 5 further comprising corner guide means attached to at least one end wall of the housing, said corner guide means being movable to an outwardly extending position in position to make engagment with the wall corner.

14. The tool of claim 5 including an inlet opening formed in the rear wall, and closure means movable between open to closed positions to control access into the housing through the inlet opening.

15. In a tool for laying plaster along a wall surface adjacent to an outside corner edge, the tool having a housing with an elongated outlet opening through which plaster is dispensed during operation of the tool, the improvement comprising guide means for mounting on the tool for movement along the elongated opening to block a predetermined portion of one end of the outlet opening including means thereon aligned with the blocked end of the opening for engaging a wall corner edge to guide the tool when laying plaster along a surface adjacent to the outside corner edge, said guide means including a guide assembly for mounting on the housing in position to close said predetermined portion of one end of the outlet opening and means for locking the guide assembly in a desired position along the outlet opening to establish a desired position for the one end of the opening, said guide assembly having an outwardly extending portion located in alignment with the blocked end of the opening for engaging an outside corner edge during movement of the tool therealong to maintain the blocked end of the opening aligned with the wall corner edge during tool movement preventing plaster from exiting the opening beyond the corner edge.

16. A plasterer's tool for applying a plaster substance to a wall surface adjacent to an outside wall corner edge defined by angularly related wall surfaces comprising a housing having spaced end walls, a wall with an elongated opening therein adjacent one side edge, an opposite wall including a wall portion pivotally attached to and extending between the end walls, and a closure wall extending between the wall with the opening therein and the opposite wall to close the space therebetween, operator means connected to the pivotal wall portion for applying pressure thereto during plastering to force plaster out through the elongated opening, and guide means mounted on the housing for movement along the elongated opening to block a pre-determined portion of one end thereof and prevent plaster from exiting the opening beyond the corner edge, said guide means including means forming an outwardly extending portion for making sliding contact with the outside wall corner edge and guide movement of the tool when applying plaster to the wall surface adjacent thereto.

17. The plasterer's tool of claim 16 including second guide means mounted on the housing adjacent to an opposite end of the elongated opening.

18. The plasterer's tool of claim 17 wherein the second guide means include means biasing the outwardly extending portion thereof resiliently toward the guide means.

* * * * *